US006358110B1

(12) United States Patent
Apsner

(10) Patent No.: US 6,358,110 B1
(45) Date of Patent: Mar. 19, 2002

(54) WEIGHT FOR TOY OR DECORATIVE BALLOONS

(75) Inventor: Vinko Apsner, Mackovci (SI)

(73) Assignee: Premium Balloon Accessories, Inc, Sharon Center, OH (US)

( * ) Notice: Subject to any disclaimer, the term of this patent is extended or adjusted under 35 U.S.C. 154(b) by 0 days.

(21) Appl. No.: 09/521,067

(22) Filed: Mar. 8, 2000

(30) Foreign Application Priority Data

Jun. 4, 1999 (SI) ..... P-9900143

(51) Int. Cl.[7] ..... A63H 3/06
(52) U.S. Cl. ..... 446/220; 446/222
(58) Field of Search ..... 446/220, 222, 446/68; 206/540, 538; 244/33, 94; 24/136 L, 136 R

(56) References Cited

U.S. PATENT DOCUMENTS 4,916,850 A * 4/1990 Dodge ..... 43/44.86
5,011,447 A * 4/1991 Watanabe ..... 446/220
5,074,510 A * 12/1991 Metz ..... 446/220
5,117,344 A * 5/1992 Perez ..... 446/220
5,454,140 A * 10/1995 Murai ..... 24/136 R
5,572,770 A * 11/1996 Boden ..... 24/136 R
5,662,510 A * 9/1997 Wolens ..... 446/220
5,755,419 A * 5/1998 Gearhart et al. ..... 446/220
5,989,093 A * 11/1999 Nelson et al. ..... 446/220

* cited by examiner

*Primary Examiner*—Kien T. Nguyen
*Assistant Examiner*—Faye Francis
(74) *Attorney, Agent, or Firm*—Renner, Kenner, Greive, Bobak, Taylor & Weber

(57) ABSTRACT

A weight for toy and decorative balloons according to the invention enables a simple and convenient selection of the amount of ribbon extending between the balloon weight and the balloon, while being adaptive to exhibiting selectively variable ballast characteristics. The weight according to the invention consists of a container (1) receiving granular weight (8) such as sand, a cover (2) closing the container (1) and an ear (3) extending from the cover for receiving and holding a ribbon (4) of a balloon (5). The ear (3) contains a hole (9) that is conical and has ribs (1) about an inner wall. A plug (12) compressively fits into the hole (9) in such a manner that the ribbon (4) of the balloon (5) runs between and is secured by them.

9 Claims, 1 Drawing Sheet

WEIGHT FOR TOY OR DECORATIVE BALLOONS

TECHNICAL FIELD

The invention herein relates to a design for a balloon weight that enables a simple and convenient selection of the length of ribbon between the weight and the balloon. The invention further relates to a balloon weight adapted for use with balloons of various buoyancies or in association with one or several balloons fastened to a single weight. The invention further relates to a balloon weight that prevents small children from opening the connection between the weight and the ribbon of the balloon.

BACKGROUND ART

The use of balloons as decorations or toys has become widely known. Many such balloons are helium-filled, providing a desired buoyancy. However, such buoyancy gives rise to the risk of the balloon floating away, to the loss of the owner and a threat to the environment and, in the case of foil balloons, to power lines. Accordingly, it has become popular to tether balloons as by a ribbon and weight assembly.

A known balloon weight is shown in U.S. Pat. No. 5,411,427 as having a flat body with a strip-like extension forming a latch of engageable locking tongues. While such balloon weights have generally been successful, the mass of the balloon weight is determined solely by the amount of plastic used to form it, such that various weights are required to counter various buoyancies. Indeed such prior art balloon weights are typically designed as a body with a definite weight such that each weight is only suitable for balloons with the same or similar buoyancy. Thus, a whole series of balloon weights of a similar form, but a different mass must be produced, wherefor several tools are necessary and also several articles have to be sold in shops, making the balloon weights unnecessarily expensive. Moreover, the latches of prior balloon weights have typically been structurally complex and not given to ease of manufacture and use.

SUMMARY OF THE INVENTION

In light of the foregoing, it is an object of the invention to provide a balloon weight for toy or decorative balloons.

Another object of the invention is to provide a balloon weight that ensures that the balloon does not fly away when children cannot continuously hold the balloon.

A further object of the invention is to provide a balloon weight that keeps the balloon at a chosen place and, by selectively adjusting the length of the ribbon between the balloon and the weight, the height of the balloon over the place where the weight is situated can be controlled.

The foregoing and other objects of the invention are achieved by a balloon weight that is designed as a container with a detachable cover that is placed on it in a form-locking manner. On a cover of the container an ear is provided, wherein a conical plug is placed in a force-locking manner, a ribbon running through the ear being clamped between the ear and the plug at a desired point defining the length of the section of the ribbon between the weight and the balloon. The plug is completely received by the ear such that the child playing cannot pull it out. Thus, no danger exists that the ribbon may inadvertently disengage the ear, allowing the balloon to fly away. Further, the plug is connected to the ear by a flexible strip that ensures a permanent connection between the weight and the plug so that the latter can not get lost, even when it is pulled out of the ear.

The container of the balloon weight is adapted to receive additional material, preferably of granular nature which makes it possible to effect an accurate determination of the weight of the complete balloon weight as required to offset the buoyancy of the balloon or several balloons fastened to the weight. Accordingly, only one type of prefabricated container with a cover and an ear and a plug is used for all different weights, significantly diminishing the costs of production and sale of the balloon weight.

From an aesthetic point of view, the container with cover and ear can be of any suitable form.

DESCRIPTION OF THE DRAWINGS

The invention is explained in more detail by the description of an embodiment and on the basis of drawings wherein.

BEST MODE FOR CARRYING OUT THE INVENTION

Figure 1:
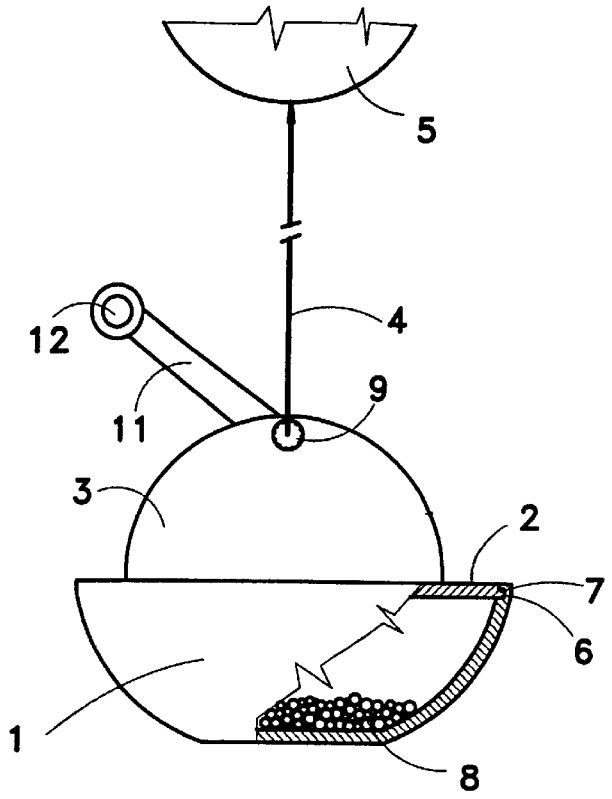
FIG. 1 shows a weight according to the invention in elevation and partial section.
Figure 2:
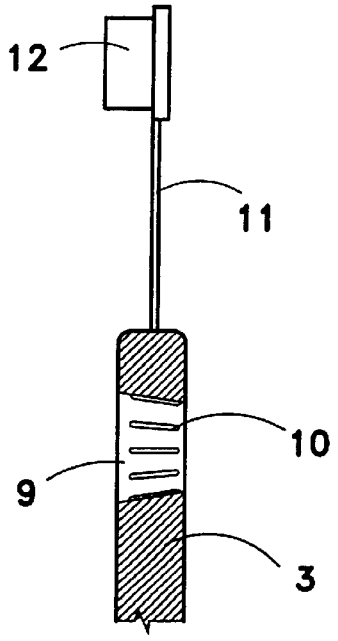
FIG. 2 shows a detail of the ear and the plug of the invention in an open state and in cross-section.
Figure 3:
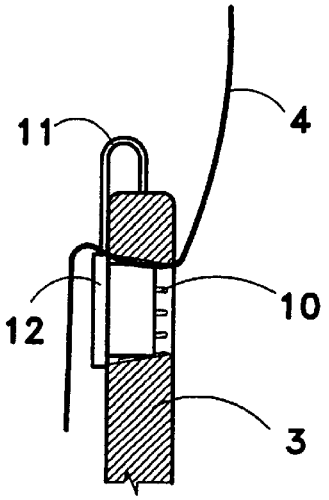
FIG. 3 shows the same in the state with the string inserted.

A weight for toy or decorative balloons consists of a container 1, a cover 2 closing the container 1 and an ear 3 extending from the cover 2 for receiving and holding a ribbon 4 of a balloon 5. The container 1 is of any optional form, as is the cover 2, which is removably connected to the container 1 in any of various known manners enabling an adult, but not a child, to open the container. Preferably, the detachable connection between the container 1 and the cover 2 is made with a groove 6 at a rim of the container 1 adapted to mate with complementary edge 7 of the cover 2. In the container 1 an additional, preferably granular weight 8 is placed, which makes it possible to effect an accurate dosing and thereby a determination of the total mass or weight in each individual case. The granular material 8 may be of any suitable nature, such as sand or the like.

On the container 1 or, more preferably on the cover 2, the ear 3 is formed for receiving and holding the ribbon 4 of the balloon 5. A hole 9 is provided in the ear 3 and is preferably conical, having longitudinal ribs 10 on its inner wall. Further, the ear 3 preferably has a flexible strip 11 extending therefrom. A plug 12 is configured to fit into the hole 9 and is maintained at the end of the strip 11. The plug 12 is flexible, so that a section of the ribbon 4 of the balloon 5 can be lockingly received between it and the ribbed inner wall of the hole 9.

The granular weight 8 is optional and used only when additional ballast is required. Preferably, an inexpensive natural material such as sand or the like of a chosen granulation is employed. The quantity of the granular material selectively establishes the total weight or mass of the balloon weight with regard to the foreseen buoyancy of the balloon or balloons for which the balloon weight 1 is to serve as a ballast.

It will be appreciated that in certain situations, for balloons with only a slight buoyancy, just the cover 2 and ear 3 with the plug 12 and without the container 1 can be used. It will further be appreciated that the container 1 and especially the ear 3 can be formed in a multitude of various ways.

It should now be appreciated that the balloon weight of the invention is adapted for a wide variety of uses, all of which are easy to employ. The length of ribbon 4 defining the spacing between the balloon 5 and container 1 can be easily selected before the plug 12 is forcefully pressed into the aperture 9 and into engagement with the ribs 10 extending from the inner sidewall of the conical aperture. Moreover, when seated with the aperture 9, the plug 12 is difficult for children to engage and remove. Additionally, the weight or mass of the balloon weight is selectable from as light as simply the cover 2 and ear 3, to as heavy as the entire assembly, including the container 1 completely full of granular material, such as sand. Accordingly, a single weight structure provides a wide range of ballast capabilities which need only be established at a point of sale.

It is to be understood that by knowing the disclosure of the invention, a person skilled in the art could make other embodiments without circumventing the substance of the invention defined in the following patent claims.

What is claimed is:

1. A weight for toy or decorative balloons, comprising:

a container for receiving a weight material;

a cover closing the container;

an ear extending from said cover for receiving and holding a ribbon of a balloon; and wherein the container and the cover are detachably connected and the ear contains a hole receiving a plug fitting into said hole, said plug securing the ribbon of the balloon as it passes through the hole.

2. A weight accordingly to claim 1, further comprising a detachable connection between said container and said cover effected by a groove at the rim of the container and a complementary edge about the cover.

3. A weight according to claim 1, wherein said additional weight is granular, a total mass of the weight being controlled by an amount of granular weight material received by said container.

4. A weight according to claim 1, wherein said plug is configured for fitting receipt by said hole and is connected to said ear by a flexible strip.

5. A weight according to claim 1, wherein said hole is conical.

6. A weight according to claim 5, wherein said hole has ribs extending from an inner wall thereof.

7. A weight according to claim 6, wherein said plug is flexible and forcefully engages said ribs.

8. A weight according to claim 7, wherein said plug is connected to said ear by a flexible strip.

9. A weight according to claim 7, wherein said plug is disk-shaped and seats against said ear when received by said hole.

* * * * *